United States Patent [19]

von der Eltz

[11] Patent Number: 4,465,490

[45] Date of Patent: Aug. 14, 1984

[54] PROCESS FOR THE CONTINUOUS DYEING OF FABRIC WEBS-FIXING WITH STEAM/AIR MIXTURE

[75] Inventor: Hans-Ulrich von der Eltz, Frankfurt am Main, Fed. Rep. of Germany

[73] Assignee: Hoechst Aktiengesellschaft, Fed. Rep. of Germany

[21] Appl. No.: 467,027

[22] Filed: Feb. 16, 1983

[30] Foreign Application Priority Data

Feb. 26, 1982 [DE] Fed. Rep. of Germany ..... 3206895

[51] Int. Cl.[3] ..... D06B 5/20; D06B 21/00; D06P 1/90

[52] U.S. Cl. ..... 8/400; 8/532; 8/533; 8/534; 8/539; 8/543; 8/650; 8/652; 8/654; 8/685; 8/917; 8/918; 8/924; 8/927; 8/922

[58] Field of Search ..... 8/400, 532, 533, 534, 8/539

[56] References Cited

U.S. PATENT DOCUMENTS 4,104,893 8/1978 Marchesini et al. ..... 68/5 E
4,260,389 4/1981 Lister ..... 8/436

FOREIGN PATENT DOCUMENTS 2552562 7/1976 Fed. Rep. of Germany .

OTHER PUBLICATIONS

Van Nostrand's Scientific Encyclopedia, 4th Ed., Princeton, N.J., p. 1433.

*Primary Examiner*—A. Lionel Clingman
*Attorney, Agent, or Firm*—Connolly and Hutz

[57] ABSTRACT

A process for the continuous dyeing of fabric webs, in which the fabric web is impregnated at a temperature between 20° and 95° C. with an aqueous liquor which contains dissolved and/or dispersed dyestuffs and squeezed, and the dyestuffs are fixed in a steam/air mixture, which comprises fixing the dyestuff without the impregnated fabric having been dried at an intermediate stage, keeping the dry temperature of the steam-/air mixture between 110° and 140° C., adjusting the steam content of the steam air mixture in such a way that the wet temperature of the moist fabric web is between 50° and 95° C., and fixing the dyestuffs for at least 20 seconds.

3 Claims, No Drawings

PROCESS FOR THE CONTINUOUS DYEING OF FABRIC WEBS-FIXING WITH STEAM/AIR MIXTURE

The present invention relates to a continuous process for dyeing fabric webs, in which the fabric web is impregnated at a temperature between 20° and 95° C. with an aqueous liquor which contains dissolved and/or dispersed dyestuffs and squeezed, and the dyestuffs are fixed in a steam/air mixture, which comprises fixing the dyestuff without the impregnated fabric web having been dried at an intermediate stage, keeping the dry temperature of the steam/air mixture between 110° and 140° C., adjusting the steam content of the steam/air mixture in such a way that the wet temperature of the moist fabric web is between 50° and 95° C., and fixing the dyestuffs for at least 20 seconds.

There are known pad-drying and pad-thermofixing methods which in the majority of cases by far are carried out on pre-dried textile material. If moist textile material is subjected to a dyestuff-fixing program, it is dried on entry into the heat-treatment field. It has also been proposed, as a variation on the dry fixing method, to effect the rate of drying by controlling the steam content of the drying medium (German Offenlegungsschrift No. 2,552,562). A lot of energy is consumed not only at the drying stage but also in the thermofixing step. A further disadvantage of this method is that migration takes place in the course of the drying process, and can bring about unlevel dyeings.

There are also known pad-steam methods which use a lot of energy, regardless of whether they are used in the form of one- or two-bath processes. In two-bath pad-steam methods the fabric is impregnated with dyestuff and then dried; fixing chemicals are then applied in a second pad process, which is why these methods are also referred to as chemical pad-steam methods. These processes use more energy still, because the textile material is not only dried but also steamed. Steaming takes place at 103°–105° C. In the one-bath pad-steam method also an intermediate drying step is carried out, which is why the same disadvantages of a high energy consumption also apply to this method. In the so-called one-bath pad-wet-steam method, the textile material entered into the steamer at 103°–105° C. is pad-wet, causing a large amount of steam to condense on the textile material. Because of the high yield losses, the process is primarily only used in the case of vat, sulfur vat and sulfur dyestuffs. Due to the absence of air the steamer, which is under a slight superatmospheric pressure, loses a lot of energy, especially during shutdown and heating-up periods.

It thus was an object of the invention to avoid the above-mentioned disadvantages, to permit good dyestuff fixation together with good penetration, and to enable a process to be used at high production speeds which is nevertheless energy-conserving. This object is achieved by the novel process described at the outset. Dyestuffs are fixed at a temperature of 50°–95° C. of the moist fabric (so-called "wet temperature") for at least 20 seconds and as a rule within no more than 200 seconds. However, in individual cases, namely as a function of the dyestuff used and/or of the textile material to be dyed, the fixing time required can also be more than 200 seconds. The temperature range mentioned, of 50°–95° C. of the moist fabric, is determined by the ratio of steam to air in the steam/air mixture. The temperature of the moist fabric web is equal to the temperature in the steam/air mixture present of a thermometer which is kept moist. Psychrometers for measuring the air content in a steam/air mixture function according to the same principle. The temperature of the steam/air mixture at 110°–140° C. (the so-called "dry temperature") is measured with a dry thermometer.

The advantages of the process according to the invention are for one that the drying step is dispensed with. Secondly, since dyestuff fixation takes place at 50°–95° C. there is no longer a need to ensure complete absence of air from the fixing zone.

The apparatus used in industry for the dyeing process according to the invention is advantageously a hotflue which is equipped with additional infrared radiators and also offers the possibility of steam injection. Because the infrared radiators are mounted within the fixing chamber, the energy supplied by these radiators is not lost. Steam is advantageously supplied at the air inlet side.

Compared to a pad-steam method, regardless of whether it is a one-bath wet steam method or a chemical pad steam method, the process according to the invention has a significantly lower steam consumption. In addition, there is no need for superatmospheric pressure. During dyestuff fixation the goods are virtually not dried. Neither does condensation, and hence an increase in the amount of water, take place, owing to the additional IR radiators installed in the fixing chamber.

The advantage on heating up the apparatus used, for example a hotflue, is especially that the metal parts of the apparatus are preheated with hot air before steam injection commences. Hereby the steam is prevented from condensing on the cold metal parts, last but not least also significantly reducing the risk of water-spotting. Since the dyestuff is fixed at a wet temperature of 95° C. or less, a steam/air mixture is present. At a wet temperature of about 80° C. the steam content within the fixing chamber is less than 30% by volume. This means that, for example, the use of stainless steel can be dispensed with, which freedom particularly benefits the costs of constructing fixing apparatus for the dyeing process according to the invention.

The injection of steam to bring about the steam/air ratio desired can be controlled in a very accurate known manner by means of a psychrometer, thereby consuming only a small amount of steam. Since the goods are virtually unable to dry, there is no dyestuff migration, and the result is optimal penetration.

The advantages of the new process chiefly reside in the possibility of saving energy, since a reduced steam content is used compared to working in a steamer at 100°–105° C. At a wet temperature of 95° C. and a dry temperature of 130° C. about 95% by volume absence of air is obtained, which figure is adequate even for many dyestuffs which are fixed in the presence of reducing agents, i.e. are sensitive to oxidation by atmospheric oxygen.

The following dyestuffs can be used in the process according to the invention:

reactive dyestuffs, acid dyestuffs, 1:2 metal complex dyestuffs, Anthrasol dyestuffs, disperse dyestuffs, cationic dyestuffs, and soluble sulfur dyestuffs.

Various types of agents having an alkaline action can be used in the case of reactive dyestuffs on cellulose fibers. In the case of reactive dyestuffs on wool it is possible to fix the dyestuff not only in the strongly acid and weakly acid range but also in the neutral and weakly alkaline range. Acid dyestuffs and metal complex dyestuffs are used for dyeing wool or polyamide fibers or mixtures of these fibers, while disperse dyestuffs are used for dyeing polyamide fibers and modified polyester fibers. Cationic dyestuffs can be used for dyeing not only acid-modified synthetic fibers but also acrylic fibers (for example in the gel state), in the absence or presence of carriers. Suitable modified polyester fibers are not only the acid-modified polyester fibers but also fibers which can be dyed without carrier and consist of polyethylene terephthalate modified with hydroxycarboxylic acids or aliphatic dicarboxylic acids or of a polyethylene terephthalate modified with polyethylene oxide to give a block polymer.

The examples which follow are intended to illustrate the process according to the invention without restricting it in any way to the features disclosed in the examples.

EXAMPLE 1

A cotton terry-towelling fabric is padded with a pick-up of 70% with an aqueous liquor which is at 20° C. and contains per liter:

- 3 g of dyestuff (Soluble Vat Green I/C.I. 59826),
- 0.5 g of calcined sodium carbonate,
- 1 g of a wetting agent consisting of alkanesulfonate as the essential constituent,
- 8 g of sodium nitrite, and
- 1 g of an impregnating auxiliary (product of the addiof 8.5 moles of ethylene oxide to 1 mole of nonylphenol)

and is treated in a chamber at 80° C. wet temperature and 110° C. dry temperature for 30 seconds. The fabric is then treated with an aqueous liquor containing per liter 20 ml of sulfuric acid (96% strength) and 1 g/liter of a dispersant (sulfo-containing formaldehyde condensation product and is finally aftertreated in a conventional manner after a 60 second air passage.

The result obtained is a green dyeing having a good dyestuff yield and good fastness properties.

The dyestuff yield is equal to that of a dyeing which has been steamed in a 100% pure steam atmosphere at 103° to 105° C. for 30 seconds and then developed.

If, as an alternative, fixing is carried out at a wet temperature of 60° C. and a dry temperature of 110° C. for 2 minutes, a dyeing is obtained which has the same dyestuff yield.

If the padded fabric is merely left at room temperature (20° C.) for 30 seconds, and then developed using, as described, sulfuric acid, merely a very pale dyeing is obtained.

EXAMPLE 2

A cotton terry-towelling fabric is padded with a pick-up of 87%, and at a linear speed of 30 m/min, with a liquor which is at 20° C. and contains per liter:

- 16 g of a dyestuff mixture which consists of the dyestuffs of the formulae

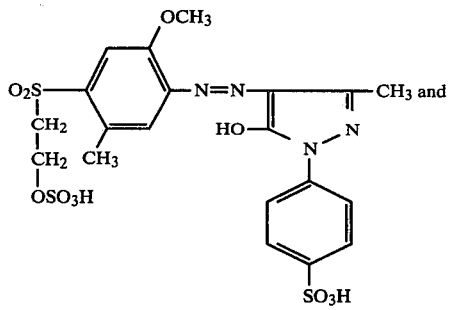

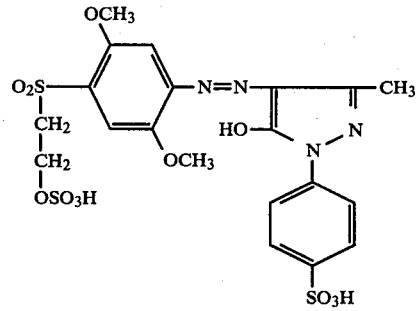

10 g of the dyestuff of the formula

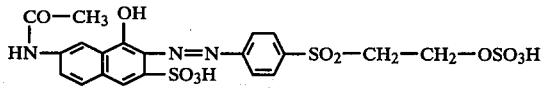

9 g of the dyestuff of the formula

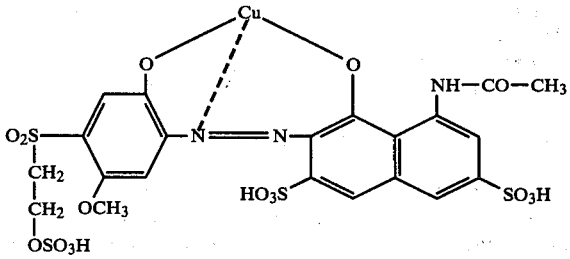

- 30 g of calcined sodium sulfate,
- 15 ml of 38° Bé (32.5% strength) sodium hydroxide solution, and
- 3 g of a wetting agent which consists of alkanesulfonate as essential constituent and is treated in a chamber at a wet temperature of 80° C. and a dry temperature of 120° C. for 40 seconds. The fabric leaving the fixing zone has a moisture content of 81%. A conventional aftertreatment produces a brown dyeing having good dyestuff properties.

If fixing is carried out in a 100% pure steam atmosphere at 103° C. for 40 seconds, a dyeing is obtained which has a markedly reduced yield (ratio of depths of dyeing: about 70:100).

EXAMPLE 3

A cotton fabric is padded with a pick-up of 70% with an aqueous liquor which is at 25° C. and contains per liter:

- 150 g of the liquid version of the dyestuff C.I. Leuco Sulphur Brown 96, 3 g of sodium hydrogensulfate,
5 g of an agent to stabilize against re-oxidation (sodium polysulfide solution), and
3 g of a wetting agent based on a mixture of low-foam anionic surfactants and is treated in a chamber at a wet temperature of 90° C. and a dry temperature of 120° C. for 60 seconds. The fabric is then rinsed cold, oxidized by means of hydrogen peroxide at 40° C., and then rinsed, first at 40° C. and then at 70° C.

A dark brown dyeing is obtained which is virtually indistinguishable, in hue and color yield, from a dyeing which has been fixed in a 100% pure steam atmosphere at 103° C. for 60 seconds.

EXAMPLE 4

A mercerized cotton fabric is padded with a pick-up 65% with an aqueous liquor which is at 20° C. and contains per liter:

50 g of the dyestuff of the formula

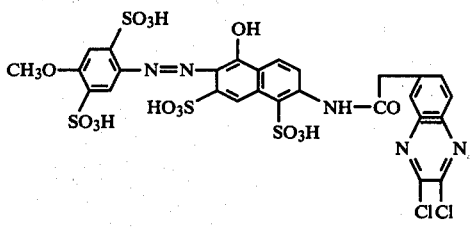

8 ml of 38° Bé (32.5% strength) sodium hydroxide solution,
12 g of calcined sodium carbonate, and
3 g of a wetting agent which consists of alkanesulfonate as essential constituent and is fixed in a chamber at a wet temperature of 80° C. and a dry temperature of 120° C. for 40 seconds, and is then aftertreated in a conventional manner.

A yellowish red dyeing is obtained which has good fastness properties.

If, in contrast, the fixing process is carried out in a 100% pure steam atmosphere at 103° C. for 60 seconds, a markedly paler dyeing is obtained.

EXAMPLE 5

A mercerized cotton fabric is padded with a pick-up of 65% with an aqueous liquor which is at 20° C. and contains per liter:

60 g of the dyestuff of the formula

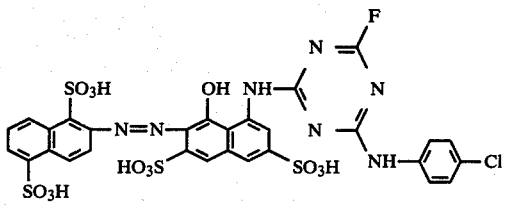

8 ml of 38° Bé (32.5% strength) sodium hydroxide solution,
10 g of calcined sodium carbonate, and
3 g of a wetting agent which consists of alkanesulfonate as essential constituent and is fixed in a chamber at a wet temperature of 80° C. and a dry temperature of 120° C. for 40 seconds, and is aftertreated in a conventional manner.

A red dyeing is obtained which has good fastness properties.

If fixing is carried out in a 100% pure steam atmosphere at 103° C. for 60 seconds, a markedly paler dyeing is obtained.

EXAMPLE 6

A mercerized cotton fabric is padded with a pick-up of 65% with an aqueous liquor which is at 20° C. and contains per liter:

20 g of the dyestuff of the formula

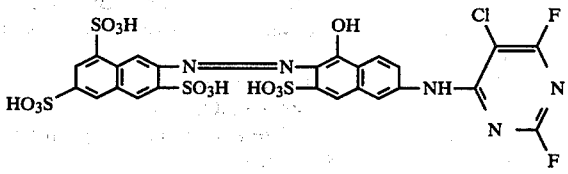

20 g of calcined sodium carbonate,
20 g of sodium sulfate, and
2 g of a wetting agent which consists of alkanesulfonate as essential constituent and is fixed in a chamber at a wet temperature of 80° C. and a dry temperature of 120° C. for 40 seconds, and aftertreated in a conventional manner.

A fast yellowish red dyeing is obtained.

If fixing is carried out in a 100% pure steam atmosphere at a temperature of 105° C. for 40 seconds, a markedly paler dyeing is obtained.

EXAMPLE 7

A cotton fabric is padded with a pick-up of 80% with an aqueous liquor which is at 20° C. and contains per liter:

150 g of the dyestuff C.I. Leuco Sulphur Blue 19,
3 g of a wetting agent based on a mixture of low-foam anionic surfactants,
3 g of sodium hydrogensulfate, and
20 g of an agent to stabilize against re-oxidation (sodium polysulfide solution)

and is treated in a chamber at a wet temperature of 80° C. and a dry temperature of 110° C. for 90 seconds, and then oxidized with an aqueous solution which is at 40° C. and contains per liter 2 ml of hydrogen peroxide, and then rinsed, first warm at 40° C. and then at 70° C. and then cold.

A blue dyeing is obtained which has good fastness properties.

EXAMPLE 8

A 20 g/liter solution of the dyestuff of the formula

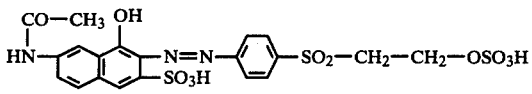

is treated at 20° C. for 1 minute with 20 ml, per liter, of 38° Bé (32.5% strength) sodium hydroxide solution, and is then brought to pH 2.5 by adding sulfuric acid.

A wool flannel fabric is padded with a pick-up of 100% with an aqueous liquor which is at 20° C. and contains the dyestuff treated as described above and, per liter, 150 g of urea, 10 g of a wetting agent (addition product of 5 moles of ethylene oxide to 1 mole of isotridecyl alcohol), 20 ml of isopropanol and is then treated in a chamber at a wet temperature of 95° C. and a dry temperature of 125° C. for 200 seconds. The fabric is then rinsed cold and subjected, at 80° C., to an emulsifier wash.

A bright yellowish red dyeing is obtained which has good fastness properties and no frosting effect.

EXAMPLE 9

A cotton cord fabric is padded with a pick-up of 75% with an aqueous liquor which is at 20° C. and contains per liter:

75 g of dyestuff (C.I. Solubilized Sulphur Brown 51),
3 g of a wetting agent based on a mixture of low-foam anionic surfactants,
25 g of calcined sodium carbonate,
115 g of sodium hydrogensulfate, and
20 g of an agent to stabilize against re-oxidation (sodium polysulfide solution)

and is then treated in a chamber at a wet temperature of 85° C. and a dry temperature of 130° C. for 90 seconds. The fabric is then rinsed cold, oxidized at 40° C. with hydrogen peroxide, and then rinsed at 40° C. and 70° C.

A brown dyeing is obtained which has good properties.

I claim:

1. A process for the continuous dyeing of fabric webs, in which the fabric web is impreganted at a temperature between 20° and 95° C. with an aqueous liquor which contains dissolved dyestuffs or dispersed dyestuffs or mixtures thereof and is squeezed, and the dyestuffs are fixed in a steam/air mixture, which comprises fixing the dyestuff without the impregnated fabric having been dried at an intermediate stage, keeping the dry temperature of the steam/air mixture between 110° and 140° C., adjusting the steam content of the steam/air mixture by controlling the injection of steam, and hence the ratio of steam to air in the steam/air mixture, by means of a psychrometer, to maintain the wet temperature of the moist fabric web between 50° and 95° C., and fixing the dyestuffs for at least 20 seconds.

2. The process as claimed in claim 1, wherein dyeing is carried out using reactive dyestuffs, acid dyestuffs, 1:2 metal complex dyestuffs, Anthrasol dyestuffs, disperse dyestuffs, cationic dyestuffs or water-soluble sulfur dyestuffs.

3. The process as claimed in claim 1, wherein the fabric webs dyed consist of cellulose fibers and their mixtures with synthetic fibers, of wool and its mixtures with synthetic fibers, of acrylic fibers, of polyamide fibers, or of modified polyester fibers and their mixtures with cellulose fibers or wool, said modified polyester fibers being acid-modified polyester fibers or polyethylene terephthalate modified with hydroxycarboxylic acids or aliphatic dicarboxylic acids or polyethylene oxide.

* * * * *